US006293341B1

(12) United States Patent
Lemetayer

(10) Patent No.: US 6,293,341 B1
(45) Date of Patent: Sep. 25, 2001

(54) METHOD OF CONTROLLING A HYDROCARBONS PRODUCTION WELL ACTIVATED BY INJECTION OF GAS

(75) Inventor: Pierre Lemetayer, Pau (FR)

(73) Assignee: Elf Exploration Production, Courbevoie (FR)

( * ) Notice: Subject to any disclaimer, the term of this patent is extended or adjusted under 35 U.S.C. 154(b) by 0 days.

(21) Appl. No.: 09/398,462

(22) Filed: Sep. 17, 1999

(30) Foreign Application Priority Data

Sep. 21, 1998 (FR) ..... 98 11728

(51) Int. Cl.[7] ..... E21B 43/12
(52) U.S. Cl. ..... 166/250.15; 166/53; 166/372
(58) Field of Search ..... 166/250.15, 305.1, 166/306, 372, 53

(56) References Cited

U.S. PATENT DOCUMENTS 5,014,789 * 5/1991 Clarke et al. ..... 166/372

FOREIGN PATENT DOCUMENTS 0 756 065 1/1997 (EP) ..... E21B/43/12
2 252 797 8/1992 (GB) ..... E21B/43/12
2 276 675 10/1994 (GB) ..... E21B/43/12
WO88/00277 * 1/1988 (WO) ..... 166/250.15

* cited by examiner

*Primary Examiner*—William Neuder
(74) *Attorney, Agent, or Firm*—Blank Rome Comisky & McCauley LLP

(57) ABSTRACT

The invention relates to a method for controlling a liquid and gaseous hydrocarbons production well (1) activated by injection of gas, the well comprising a production string (2) fitted with an adjustable-aperture outlet choke (9), into which gas, the flow rate of which can be adjusted by means of a control valve (6), is injected, the method being characterized in that it comprises a start-up phase which consists in performing the following sequence of steps:

a step of initiating the production of hydrocarbons a step of ramping up to production speed followed by a production phase, during which phases the outlet choke (9) and the control valve (6) are operated in such a way as to maintain the stability of the flow rate of the produced hydrocarbons.

7 Claims, 3 Drawing Sheets

METHOD OF CONTROLLING A HYDROCARBONS PRODUCTION WELL ACTIVATED BY INJECTION OF GAS

TECHNICAL FIELD

The present invention relates to a method for controlling a liquid and gaseous hydrocarbons production well activated by injection of gas from a source of pressurized gas, the hydrocarbons produced being processed in a downstream treatment unit fed by the well.

STATE OF THE PRIOR ART

Document GB 2,252,797 describes a method for controlling the production flow rate of an oil well, which well comprises a hydrocarbons production string leading to a well head and defining, with the wall of the well, an annular space, the string being fitted with at least one gas inlet valve communicating with a source of pressurized gas via a control valve which allows the flow rate of gas towards the inside of the production string to be controlled, and with an outlet choke for governing the flow of hydrocarbons in the production string, the method consisting in controlling the control valve and the outlet choke as a function of the temperature and pressure measurements taken at the surface and in the annular space and as a function of measurements of pressure and flow rate of the gas emanating from the source.

Document EP 0,756,065 describes a system for controlling the production of hydrocarbons through an outlet pipe which extends to a production well activated by injection of gas.

This system comprises:

- an outlet choke for controlling the flow rate of hydrocarbons through the outlet pipe, and
- a control module for dynamically controlling the aperture of the outlet choke.

The control module dynamically controls the aperture of the choke as a function of the variations in pressure in the gas injection pipe.

According to a particular embodiment, the control module comprises a PID algorithm which stabilizes and minimizes the pressure in the gas injection pipe on the basis of the pressure in this pipe measured by means of a sensor, this pressure being used as an input signal, and which at output, delivers a signal of the position of the outlet choke.

This method and this device are not able to achieve efficient control over the production of hydrocarbons when a plug of gas forms when the well enters a production phase as a result of the opening of the outlet choke, or when a plug of liquid forms when the injected gas starts to rise, particularly when the pressure of the injected gas is very high.

These plugs have the effect of initiating disturbances, particularly cyclic disturbances, in the production of hydrocarbons, which are manifested in an irregular supply to the hydrocarbons-treatment units downstream, such as the liquid/gas separation unit, gas recompression and treatment units.

The consequences of this irregular supply to the downstream hydrocarbons-treatment units are, among other things, a reduction in the amount of gas available for activating the well and an increase in the risks of tripping, which are manifested by a reduction in production.

Another consequence of these disturbances is that wear on the hole-layer connection is accentuated, particularly in wells with unconsolidated reservoirs, which leads to the ingress of sand which requires sand control equipment and frequent and expensive restoration of damaged wells.

Something else that these methods are unable to achieve is optimum stable production after the start-up phase with a minimum gas flow rate, or efficient compensation for disturbances resulting from the random behaviour of the reservoir, failure of string equipment, or bringing the well into a production phase efficiently when gas availability is low.

The object of the present invention is precisely to alleviate these drawbacks. To this end, it provides a method for controlling a liquid and gaseous hydrocarbons production well activated by injecting gas, which well comprises at least one production string inside a casing and defining, with the said casing, an annular space connected by a pipe for injecting gas, through a control valve, to a source of pressurized gas, the said production string being fitted with at least one gas inlet valve and extended by an outlet pipe fitted with an adjustable-aperture outlet choke, the method being characterized in that, with the control valve and the outlet choke closed, it comprises a start-up phase which consists in performing the following sequence of steps:

- a step of initiating the production of hydrocarbons consisting:
  - in comparing the pressure downstream of the control valve with two predetermined thresholds PCH1 and PCH2, PCH2 being higher than PCH1, and
    - a) if this pressure is below the threshold PCH1, in opening the control valve so as to insect gas into the annular space at a predetermined flow rate Q1,
    - b) if this pressure is between the thresholds PCH1 and PCH2, in opening the control valve so as to inject gas into the annular space at a predetermined flow rate Q2 higher than Q1, and
    - c) when this pressure reaches the threshold PCH2, in adjusting the flow rate of gas injected into the annular space to a predetermined value Q3 higher than Q1,
  - in gradually opening the choke to a predetermined value so as to achieve a predetermined minimum produced-hydrocarbons flow rate,
- a step of ramping up to production speed, which consists in performing the following operations:
  - comparing the produced-hydrocarbons flow rate with a predetermined threshold T1 and, if the said flow rate exceeds the said threshold continuously for a predetermined length of time D1, increasing the aperture of the choke to a predetermined value, and if not, repeating the comparison,
  - waiting for a predetermined length of time to allow the minimum hydrocarbons flow rate to become established,
  - comparing the produced-hydrocarbons flow rate with a threshold T2 which is higher than T1 and comparing the pressure upstream of the choke with a predetermined pressure P1 and, if the said flow rate and the said pressure simultaneously exceed the said thresholds continuously for the length of time D1, finishing the start-up phase, and if not, repeating the comparison.

According to another feature of the invention, the step of ramping up to speed in the start-up phase additionally consists in periodically performing the following operations:

- calculating the derivative with respect to time of the pressure downstream of the control valve,
- comparing this derivative with a predetermined negative threshold and with a predetermined positive threshold, and
  - if the derivative of pressure is below the negative threshold, increasing the injected-gas flow rate by a predetermined amount, if the derivative of pressure is above the positive threshold, decreasing the injected-gas flow rate by a predetermined amount.

According to another feature of the invention, the start-up phase is followed by a production phase which consists in performing the following operations in parallel:

comparing the produced-hydrocarbons flow rate with four predetermined thresholds SR1, SR2, SR3 and SR4, SR2 being higher than SR1, SR4 being higher than SR3, and:

if the produced-hydrocarbons flow rate is below SR1 and if the injected-gas flow rate is below a predetermined threshold, increasing the said flow rate by a predetermined amount, if the produced-hydrocarbons flow rate is above SR2 and if the injected-gas flow rate is above a predetermined threshold, decreasing the said flow rate by a predetermined amount, if the produced-hydrocarbons flow rate is below SR3 and if the aperture of the outlet choke is below a predetermined threshold, increasing the aperture of the said choke by a predetermined amount, if the produced-hydrocarbons flow rate is above SR4 and if the aperture of the outlet choke is above a predetermined threshold, reducing the aperture of the said choke by a predetermined amount, repeating the previous comparison, comparing the produced-hydrocarbons flow rate with a predetermined threshold and, if the said flow rate is below the said threshold, resuming the start-up phase.

According to another feature of the invention, the production phase consists in also periodically performing the following operations:

calculating the derivative with respect to time of the pressure downstream of the control valve, comparing this derivative with a predetermined negative threshold and with a predetermined positive threshold, and if the derivative of pressure is below the negative threshold, increasing the injected-gas flow rate by a predetermined amount, if the derivative of pressure is above the positive threshold, decreasing the injected-gas flow rate by a predetermined amount.

According to another feature of the invention, the produced-hydrocarbons flow rate is measured using a flow meter mounted on the outlet pipe upstream of the outlet choke.

According to another feature of the invention, the produced-hydrocarbons flow rate is estimated on the basis of measurement of the temperature of the produced hydrocarbons upstream of the outlet choke.

According to a last feature of the invention, the produced-hydrocarbons flow rate is estimated on the basis of the pressure difference across the outlet choke and the aperture of the said choke.

BRIEF DESCRIPTION OF THE DRAWINGS

The invention will be better understood from reading the following description given by way of example, with reference to the appended drawings in which.

DETAILED DESCRIPTION OF THE INVENTION

In general, the method of the invention is used to control a hydrocarbons production well activated by injection of gas from a source of pressurized gas, which well supplies downstream units for processing the said hydrocarbons.

Figure 1:
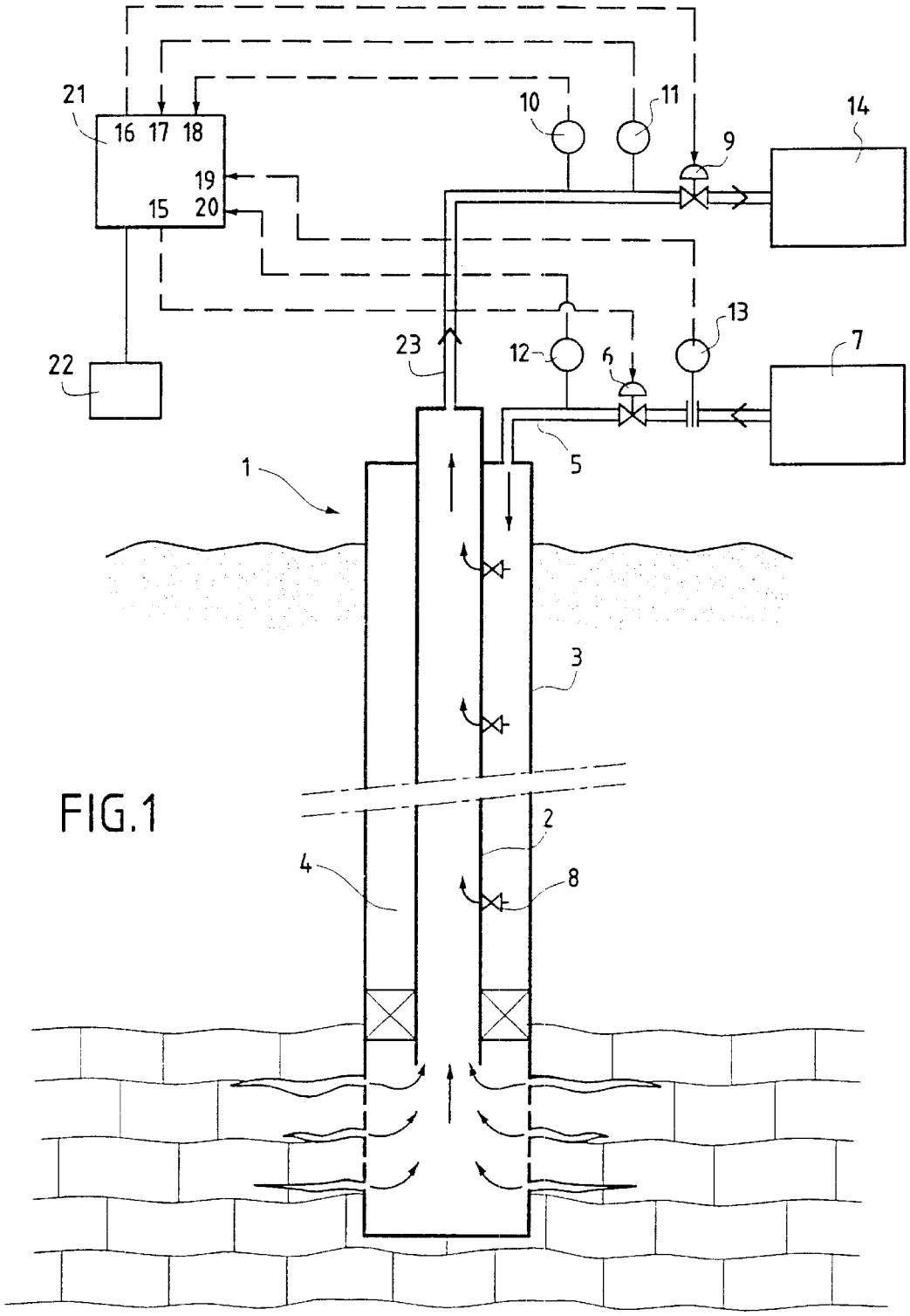
FIG. 1 depicts a hydrocarbons production well activated by injection of gas and comprising a single production string.

FIG. 1 depicts a well 1 for producing hydrocarbons in the form of a mixture of liquid and gas and which comprises:

a production string 2, a casing 3 surrounding the string 2, an annular space 4 defined by the string 2 and the casing 3, a source 7 of pressurized gas, a number of valves 8 through which gas enters the string 2 from the annular space 4, downstream treatment units 14, a pipe 5 for injecting gas into the annular space 4 and connecting the source 7 of gas through a control valve 6, a produced-hydrocarbons outlet pipe 23 connecting the upper part of the string 2 to the downstream treatment units 14 through a variable-aperture outlet choke 9, a sensor 10 for measuring the temperature upstream of the choke 9, which delivers an electronic signal which represents this temperature, a sensor 11 sensing pressure upstream of the choke 9, which delivers an electronic signal which represents this pressure, a sensor 12 sensing pressure downstream of the control valve 6, which delivers an electronic signal which represents this pressure, a sensor 13 sensing the injected-gas flow rate, placed upstream of the control valve 6, which delivers an electronic signal which represents this flow rate, a programmable controller 21 with inputs 17, 18, 19 and 20 which respectively receive the electronic signals delivered by the sensors 11, 10, 13 and 12, and with outputs 15 and 16 which respectively deliver signals for controlling the outlet choke 9 and the control 6, means 22 for dialogue between operator and controller 21.

The controller 21 also comprises, and this is not depicted in FIG. 1, a memory already loaded with a control program and with the data needed for controlling the hydrocarbons production well, particularly all the predetermined values of the adjustment variables. This data is entered beforehand by an operator using the operator/controller dialogue means 22 and can be updated during production using the same means.

Some of this data may be entered by a control-assistance computer, not depicted in the FIG. 1.

The controller 21 slaves the injected-gas flow rate measured by means of the sensor 13, to a value determined according to the control program, the values of the adjustment variables and as a function of the signals delivered by the sensors 10, 11, 12 and 13, by action on the control valve 6.

Before the hydrocarbons transfer device enters service, the outlet choke 9 and the control valve 6 are closed.

The method of the invention comprises a phase of starting up the transport device, comprising two steps. The first step is a step of initiating the production of hydrocarbons, during which step the controller 21 compares the pressure downstream of the control valve 6, measured by means of the sensor 12, with two thresholds PCH1 and PCH2 which are predetermined from the characteristics of the gas inlet valves 8, for example PCH1=20% of the pressure and PCH2=to 95% of the nominal pressure of the gas source 7.

If this pressure is below the threshold PCH1, this means that the pressure in the angular space 4 is such that there is a risk of damaging the gas inlet valves 8. To eliminate this risk, the pressure in the annular space 4 has to be increased very gradually.

To do this, the controller 21 delivers, on the output 15, a signal to open the control valve 6 until an injected-gas flow rate reaches a value Q1 which is predetermined as a function of the volume of the annular space 4, for example 2% of the injected-gas flow rate for which the well was designed.

If this pressure is between the thresholds PCH1 and PCH2, this means that there is not enough pressure for injection through the valves 8 to be able to commence. When this is the case, the controller 21 delivers, on the output 15, a signal to open the control valve 6 to ensure an injected-gas flow rate Q2 higher than Q1 and predetermined as a function of the availability of gas from the source 7, for example 10% of the flow rate for which the well was designed.

When this pressure reaches the threshold PCH2, the controller 21 delivers, on the output 15, a signal to open the control valve 6 to ensure an injected-gas flow rate Q3 higher than Q1 and predetermined as a function of the characteristics of the valves 8, for example 20% of the flow rate for which the well was designed.

The controller then gradually opens the choke 9 to a value which is predetermined in such a way as to achieve a predetermined minimum flow rate for the produced hydrocarbons, for example 25% of the flow rate for which the well was designed.

Now that the step of initiating the production of hydrocarbons has been completed, the start-up phase continues with the performing of a step of ramping up to production speed, during which step the controller performs the following operations.

It estimates the produced-hydrocarbons flow rate, from a measurement of their temperature supplied by the sensor 10, using the following formula:

$$Q=Qo+\lambda\sqrt{T-To}$$

in which:

- Q represents the estimated flow rate of produced hydrocarbons,
- Qo, To and λ are characteristic constants of the well,
- T is the temperature of the hydrocarbons in the pipe 23 supplied by the sensor 10.

Then it compares the estimated hydrocarbons flow rate with a predetermined threshold T1 which represents the minimum flow rate, namely, for example, 25% of the flow rate for which the well was designed.

If, continuously, the estimated produced hydrocarbons flow rate exceeds the threshold T1 for a predetermined length of time D1 of, for example, 20 minutes, the controller delivers, on the output 16, a signal to open the choke (9) to a predetermined value, for example 30% of its maximum aperture.

Otherwise, the controller 21 repeats the previous comparison.

When the produced-hydrocarbons flow rate is practically stabilized, that is to say after waiting a predetermined length of time which corresponds to the time taken to sweep the production string, for example 60 minutes, the controller 21 compares the produced-hydrocarbons flow rate estimated from the measurement of the temperature upstream of the choke 9 with a threshold T2 which is higher than T1 and equal, for example, to 50% of the production flow rate for which the well was designed.

It then compares the produced-hydrocarbons flow rate estimated on the basis of the temperature measurement supplied by the sensor 10 with the threshold T2 and compares the pressure upstream of the choke 9 with a predetermined threshold P1.

If, simultaneously, the estimated produced hydrocarbons flow rate exceeds the threshold T2 and if the pressure upstream of the choke 9 exceeds the threshold P1 for a predetermined length of time, for example equal to 20 minutes, the controller 21 performs the production phase operations.

If this double condition is not satisfied, the controller 21 repeats the step of initiating production.

In addition, it periodically calculates the derivative with respect to time of the pressure downstream of the control valve 6 and compares it with a predetermined negative threshold dPC1 and with a predetermined positive threshold dPC2.

If this derivative, that is to say the rate of variation of the pressure downstream of the valve 6, is lower than dPC1 which represents the acceptable limit on the drop of annular pressure, to prevent the gas inlet valves 8 at the upper part of the production string 2 from closing too early and to prevent the annular pressure from becoming too low for gas to be injected through the valves 8 in the upper part of the string 2, the controller 21 increases the injected-gas flow rate by a predetermined amount, by increasing the datum value to which this flow rate is slaved, which manifests itself in a signal to open the valve 6 which is delivered by the controller 21 on the output 15.

If this derivative is lower than dPC2 which represents the acceptable limit on the increase in pressure in the annular space 4, the controller 21 reduces the injected-gas flow rate by a predetermined amount by reducing the datum value to which this flow rate is slaved, which manifests itself in a signal to close the valve 6 which is delivered by the controller 21 on the output 15.

Now that the start-up phase has been completed, the method of the invention comprises a production phase during which the controller 21 estimates the produced-hydrocarbons flow rate as above, on the basis of the measurement of temperature upstream of the choke 9, then compares it with four thresholds SR1, SR2, SR3 and SR4 which are predetermined as a function of the flow rate for which the well was designed, for example, in terms of percentage of this flow rate: SR1=75%, SR2=90%, SR3=85%, SR4+100%.

If the estimated produced-hydrocarbons flow rate is below SR1 and if the injected-gas flow rate is below a threshold QGS which has been predetermined as a function of the characteristics of the well and of its equipment, for example 60% of the maximum gas flow rate for which the well was designed, the controller 21 increases the injected-gas flow rate by a predetermined amount, for example 30% of the maximum gas flow rate for which the well was designed, by modifying the datum value to which this flow rate is slaved.

If the estimated produced-hydrocarbons flow rate is below SR2 and if the injected-gas flow rate is below a threshold QGI predetermined as a function of the characteristics of the well and of its equipment, for example 10% of the maximum gas flow rate for which the well was designed, the controller 21 reduces the injected-gas flow rate by a predetermined amount, for example 2% of the maximum gas flow rate for which the well was designed, by modifying the datum value to which this flow rate is slaved.

If the estimated produced-hydrocarbons flow rate is below SR3 and if the aperture of the choke 9 is below a threshold which was predetermined as a function of the characteristics of the well and of its equipment, for example a 100% of the maximum aperture of the choke 9, the controller 21 increases the aperture of the choke 9 by a predetermined amount, for example 3% of the maximum aperture.

If the estimated produced-hydrocarbons flow rate is above SR4 and if the aperture of the choke 9 is above a threshold which has been predetermined as a function of the characteristics of the well and of its equipment, for example 60% of the maximum aperture of the choke 9, the controller 21 reduces the aperture of the choke 9 by a predetermined amount, for example 3% of the maximum aperture.

In parallel, the controller 21 compares the estimated produced-hydrocarbons flow rate with the threshold T1 defined earlier, and if this flow rate is below T1, the controller resumes the start-up phase.

By virtue of the combined action on the output choke and on the control valve for the injection of gas in accordance with the method of the invention, the first plug of gas and the first plug of liquid in the start-up phase are damped out and the production of hydrocarbons is stabilized by a stable and minimized injection of gas into the production string.

Figure 2:
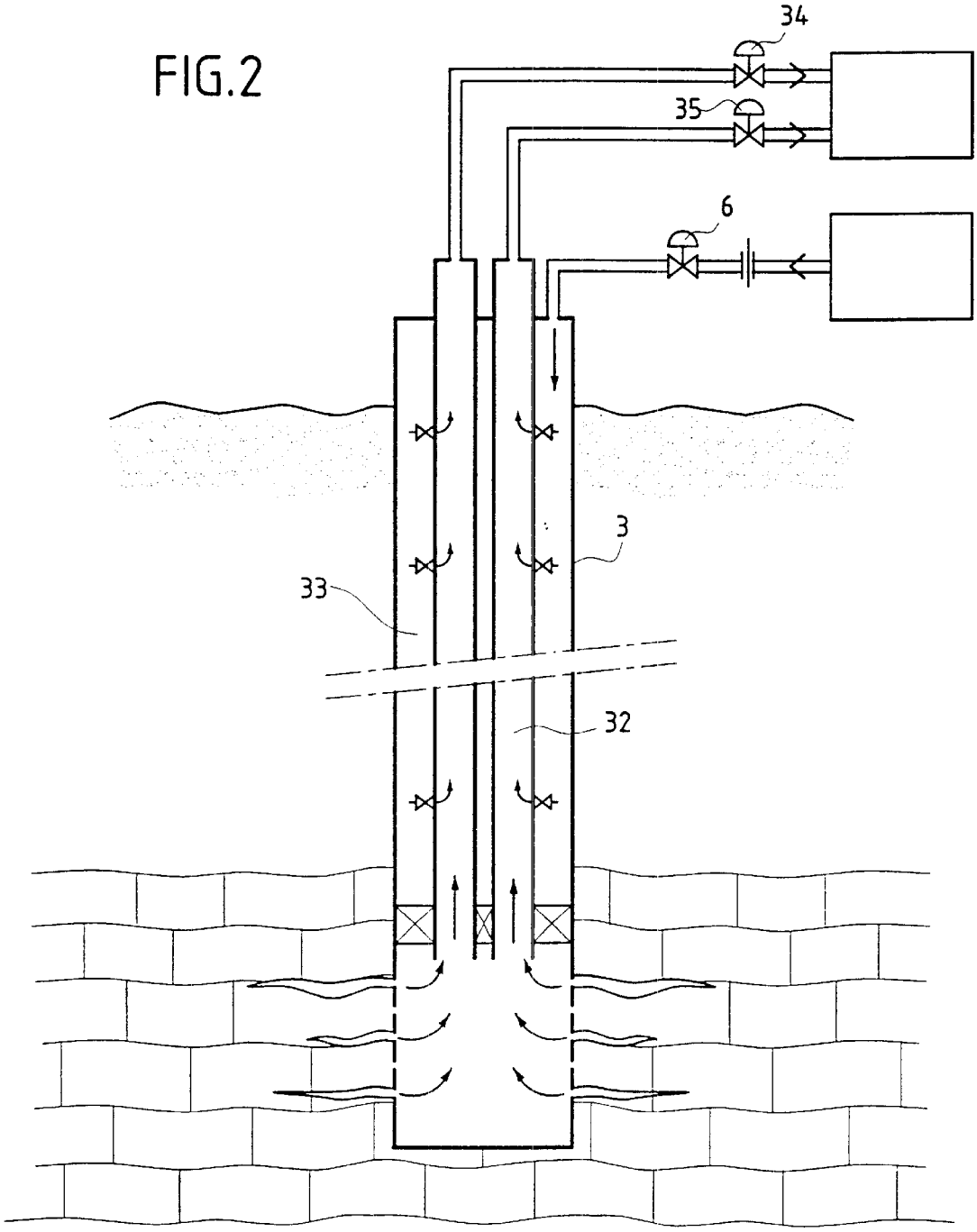
FIG. 2 depicts a hydrocarbons production well activated by injection of gas and comprising two production strings.
Figure 3:
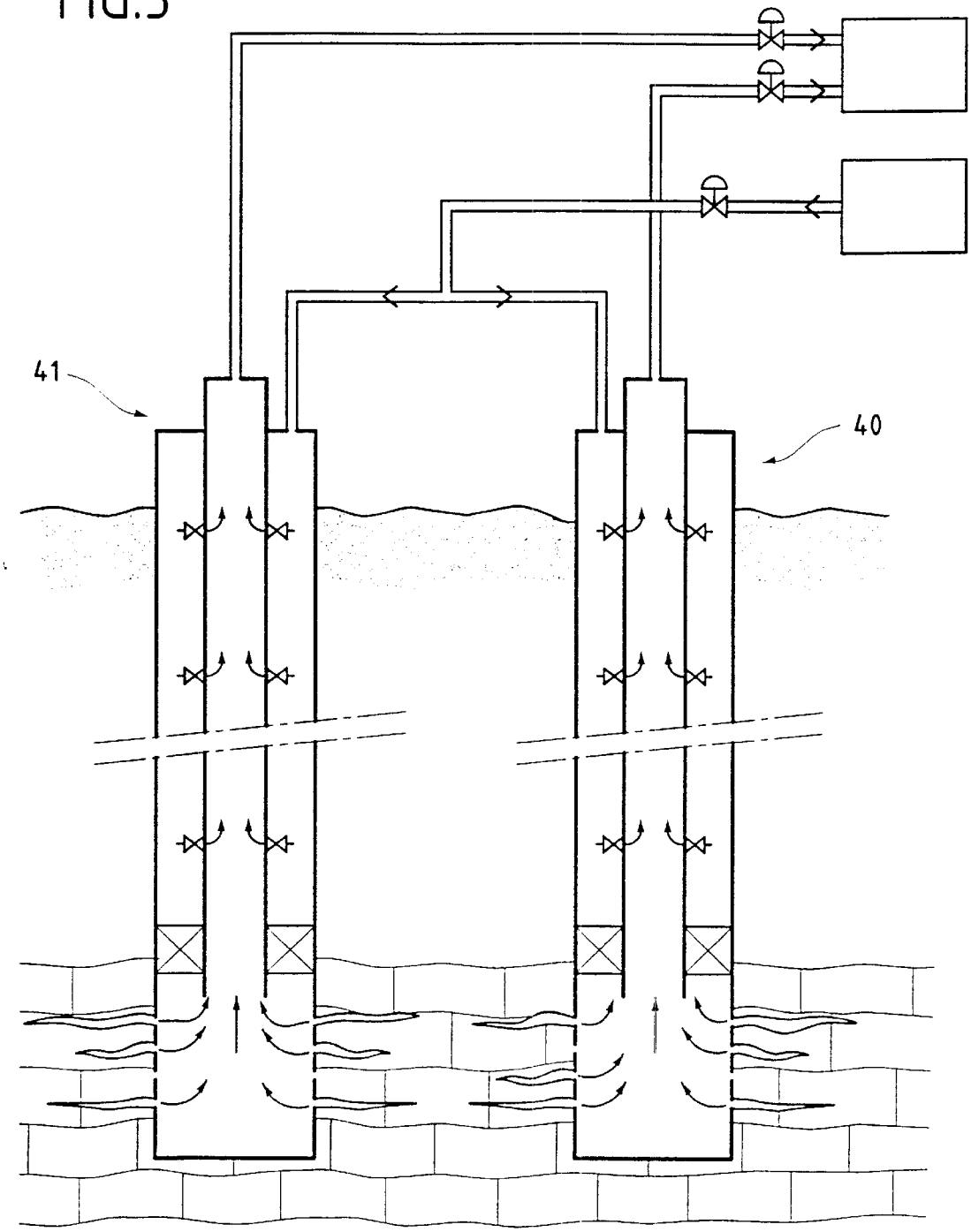
FIG. 3 depicts two hydrocarbons production wells activated by injection of gas, the flow rate of which is adjusted by a single control valve.

The abovedescribed method of the invention implemented for the control of a hydrocarbons production well, is not limited to the control of this type of well; it is also applicable, through adaptations which are within the competence of the person skilled in the art in this field, to the control of other types of wells such as:

wells of the "dual completion" type like the one depicted diagrammatically in FIG. 2, which has, in a single casing 3, two production strings 32 and 33 and two produced-hydrocarbons outlet chokes 34 and 35, by way of example, the control valve 6 control gas flow rate is the sum of the flow rates determined by the control program for each of the production strings, and the start-up phase on one string is suspended until production on the other string have exceeded a predetermined threshold, of the axial gas-injection type, in which the activating gas is injected by a pipe arranged inside the production string of the "common gas supply" type which has a gas-injection pipe common to two wells 40 and 41.

What is claimed is:

1. Method for controlling a liquid and gaseous hydrocarbons production well activated by injecting gas, which well comprises at least one production string inside a casing and defining, with the said casing, an annular space connected by a pipe for injecting gas, through a control valve, to a source of pressurized gas, the said production string being fitted with at least one gas inlet valve and extended by an outlet pipe fitted with an adjustable-aperture outlet choke, the method comprising, with the control valve and the outlet choke closed, a start-up phase which comprises performing the following sequence of steps:

initiating the production of hydrocarbons comprising:

comparing the pressure downstream of the control valve with two predetermined pressure thresholds PCH1 and PCH2, PCH2 being higher than PCH1, and a) if this pressure is below the threshold PCH1, opening the control valve so as to inject gas into the annular space at a predetermined flow rate Q1, b) if this pressure is between the thresholds PCH1 and PCH2, opening the control valve so as to inject gas into the annular space at a predetermined flow rate Q2 higher than Q1, and c) when this pressure reaches the threshold PCH2, adjusting the flow rate of gas injected into the annular space to a predetermined value Q3 higher than Q1, gradually opening the choke to a predetermined value so as to achieve a predetermined minimum produced-hydrocarbons flow rate, ramping up to production speed, which comprises performing the following operations:

comparing the produced-hydrocarbons flow rate with a predetermined flow rate threshold T1 and, if the said flow rate exceeds the said threshold continuously for a predetermined length of time D1, increasing the aperture of the choke to a predetermined value, and if not, repeating the comparison of the produced-hydrocarbons flow rate with the threshold T1, waiting for a predetermined length of time to allow the minimum hydrocarbons flow rate to become established, comparing the produced-hydrocarbons flow rate with a flow rate threshold T2 which is higher than T1 and comparing the pressure upstream of the choke with a predetermined pressure P1 and, if the said flow rate and the said pressure simultaneously exceed the said thresholds continuously for the length of time D1, performing a production phase, and if not, repeating the comparison of the produced hydrocarbon flow rate with the threshold T1 and the comparison of the pressure upstream of the choke with the predetermined pressure P1.

2. Method according to claim 1, wherein the step of ramping up to production speed in the start-up phase additionally comprises periodically performing the following operations:

calculating the derivative with respect to time of the pressure downstream of the control valve, comparing this derivative with a predetermined negative pressure derivative threshold and with a predetermined positive pressure derivative threshold, and if the derivative of pressure is below the negative pressure derivative threshold, increasing the injected gas-flow rate by a predetermined amount, if the derivative of pressure is above the positive pressure derivative threshold, decreasing the injected-gas flow rate by a predetermined amount.

3. Control method according to claim 1 wherein during the production phase following the start-up phase the following operations are performed in parallel:

comparing the produced-hydrocarbons flow rate with four predetermined flow rate thresholds SR1, SR2, SR3 and SR4, SR2 being higher than SR1, SR4 being higher than SR3, and:

if the produced-hydrocarbons flow rate is below SR1 and if the injected-gas flow rate is below a predetermined gas flow rate threshold, increasing the said flow rate by a predetermined amount, if the produced hydrocarbons flow rate is above SR2 and if the injected-gas flow rate is above a predetermined gas flow rate threshold, decreasing the said flow rate by a predetermined amount, if the produced-hydrocarbons flow rate is below SR3 and if the aperture of the outlet choke is below a predetermined aperture threshold, increasing the aperture of the said choke by a predetermined amount, if the produced-hydrocarbons flow rate is above SR4 and if the aperture of the outlet choke is above a predetermined aperture threshold, reducing the aperture of the said choke by a predetermined amount, comparing the produced-hydrocarbons flow rate with a predetermined flow rate value and, if the said flow rate is below the said value, resuming the start-up phase.

4. Method according to claim 3, wherein the production phase comprises also periodically performing the following operations:

calculating the derivative with respect to time of the pressure downstream of the control valve, comparing this derivative with a predetermined negative pressure derivative threshold and with a predetermined positive pressure derivative threshold, and if the derivative of pressure is below the negative pressure derivative threshold, increasing the injected-gas flow rate by a predetermined amount, if the derivative of pressure is above the positive pressure derivative threshold, decreasing the injected-gas flow rate by a predetermined amount.

5. Method according to claim 1, wherein the produced-hydrocarbons flow rate is measured using a flow meter mounted on the outlet pipe upstream of the outlet choke.

6. Method according to claim 1, wherein the produced-hydrocarbons flow rate is estimated on the basis of measurement of the temperature of the produced-hydrocarbons upstream of the outlet choke.

7. Method according to claim 1, wherein the produced-hydrocarbons flow rate is estimated on the basis of the pressure difference across the outlet choke and of the aperture of the said choke.

* * * * *